US006174175B1

(12) United States Patent
Behfar et al.

(10) Patent No.: US 6,174,175 B1
(45) Date of Patent: Jan. 16, 2001

(54) HIGH DENSITY Z-AXIS CONNECTOR

(75) Inventors: Alex A. Behfar, Poughquag; Dale Curtis McHerron, Staatsburg; Charles Hampton Perry, Poughkeepsie, all of NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/301,568

(22) Filed: Apr. 29, 1999

(51) Int. Cl.[7] ..... H01R 4/58
(52) U.S. Cl. ..... 439/91
(58) Field of Search ..... 439/66, 74, 91; 29/879

(56) References Cited

U.S. PATENT DOCUMENTS

| | | | | |
|---|---|---|---|---|
| 4,003,621 | * | 1/1977 | Lamp | 439/586 |
| 4,509,099 | * | 4/1985 | Takamatsu et al. | 361/413 |
| 5,033,675 | * | 7/1991 | Shino | 439/66 |
| 5,051,366 | * | 9/1991 | Anderson et al. | 439/67 |
| 5,101,553 | * | 4/1992 | Carey | 29/882 |
| 5,155,905 | * | 10/1992 | Miller, Jr. | 29/843 |
| 5,471,151 | | 11/1995 | DiFrancesco | 324/762 |
| 5,475,318 | | 12/1995 | Marcus et al. | 324/762 |
| 5,500,605 | * | 3/1996 | Chang | 324/758 |
| 5,509,203 | * | 4/1996 | Yamashita | 29/879 |
| 5,531,022 | * | 7/1996 | Beaman et al. | 439/66 |
| 5,541,522 | | 7/1996 | Rosen et al. | 324/642 |
| 5,624,268 | * | 4/1997 | Maeda et al. | 439/66 |
| 5,637,176 | * | 6/1997 | Gilleo et al. | 156/277 |
| 5,833,471 | * | 11/1998 | Selna | 439/73 |
| 6,027,346 | * | 2/2000 | Sinsheimer et al. | 439/66 |
| 6,037,786 | * | 3/2000 | Palagonia | 324/754 |

* cited by examiner

*Primary Examiner*—Neil Abrams
*Assistant Examiner*—Hae Moon Hyeon
(74) *Attorney, Agent, or Firm*—John A. Jordan; Tiffany L. Townsend

(57) ABSTRACT

An electrical connector or interposer for making connection in a high density device electronic environment. The connector is made of a high density array of nickel columns held in a layer of polyimide with each column extending beyond the opposing surfaces of said layer of polyimide. The connector may be used to make temporary or permanent connection to electrical contacts without alignment. Connection may be accomplished by loading forces sufficient to form either an indentation or a penetration of solder ball contacts. Contact to a single chip or a full wafer of chips is facilitated for testing.

7 Claims, 5 Drawing Sheets

HIGH DENSITY Z-AXIS CONNECTOR

BACKGROUND OF THE INVENTION

1. Field of the Invention

The present invention relates to electrical interconnectors. More particularly, the present invention relates to an electrical interconnector which acts as an interposer between opposing arrays of conductors and may be used for making connection for contact testing of single chips or a full wafer of chips.

2. Background and Related Art

Various techniques exist in the prior art for making the connection of electronic devices to one another at electrical contacts, be the contacts wire bond pads, solder ball contacts or similar type connection points. One reason for making these connections is for device test purposes. Device testing apparatus typically takes the form of an array of test probes which align with the array of electrical contact points on the device to be tested. These probe arrangements, however, have limitations, such as, physical limitation because of the size and spacing of their probes as compared to the size and spacing of contact points in high density devices. Thus, with the increasing density of contacts on chips, for example, it becomes more and more difficult to fabricate probe arrays with probe densities adequate to make proper electrical connection to a chip, wafer or substrate. Another limitation to known probe arrangements resides in the limitations on their clock speed. Typically, the clock speed of such arrangements is limited to no more than around 400 MHz.

In accordance with the teachings of the present invention, a high density Z-axis connector or interposer is provided which allows for making good conformal contact to an array of dense electrical contact points on a chip, wafer or similar electrical device. The connector or interposer may be used between opposing sets or arrays of contacts, as between, for example, the array of contacts on a chip or wafer and the corresponding opposing array of contacts on the underlying substrate. Such an arrangement may, in accordance with the present invention, be used for the electrical testing of the chip, full wafer of chips or substrate or may, alternatively, be used for a more permanent connection between opposing arrays of electrical contacts.

The connector or interposer in accordance with the present invention comprises an array or matrix of closely spaced metal probes or columns held in position in a sheet of insulating material. Although various metals could be used to fabricate the probes, nickel is preferred. Typically, the insulating material would be polyimide and conventional deposition and removal techniques can be used to fabricate the array or matrix of closely spaced metal columns to form the connector or interposer in accordance with the present invention.

In accordance with the present invention, a connector or interposer is provided having an array or matrix of metal columns with each column typically being around 25 microns in diameter, 50 microns long and configured in the matrix so that they are each 50 microns on center in both the X and Y direction. Such an array may be used to test one chip at a time or a full wafer of chips at the same time with an AC bandwidth in excess of 1 GHz.

Accordingly, it is an object of the present invention to provide an electrical connector or interposer which makes good electrical contact between highly dense opposing sets or arrays of electrical contact points.

It is another object of the present invention to provide an electrical connector or interposer which does not require alignment to make good electrical contact between opposing arrays of electrical contact points.

It is a further object of the present invention to provide an electrical connector or interposer which may be used to test a single chip or a full wafer of chips.

It is yet another object of the present invention to provide an electrical connector or interposer which may be used to test a single chip or a full wafer of chips having clock speeds up to 1 GHz.

It is yet a further object of the present invention to provide an electrical connector or interposer which makes good electrical contact to each of a highly dense array of contact points for either temporary or permanent connection.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION

Figure 1:
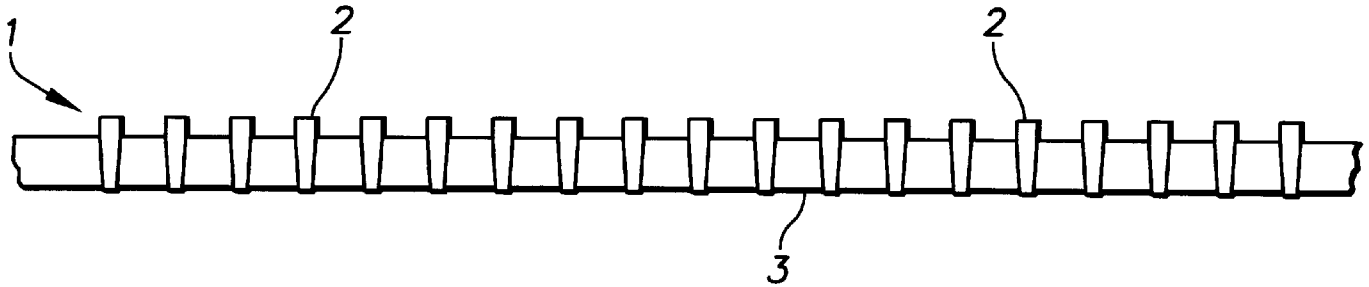
FIG. 1 shows a side cross-sectional view of the electrical connector or interposer in accordance with the present invention.

The present invention will be best understood by reference to the accompanying drawings. With reference to FIG. 1, there is shown a side cross-sectional view of a portion of the connector 1 in accordance with the present invention. As can be seen, an array of metal columns 2 are shown imbedded in a layer 3 of insulating material. In the preferred embodiment the metal columns are made of nickel and the insulating material is made of polyimide. It is clear that any of a variety of metals and insulating materials may be used for this purpose.

Figure 2:
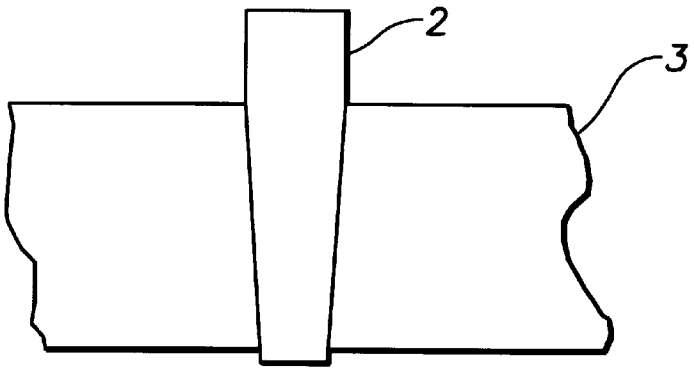
FIG. 2 shows an enlarged segment of the view of FIG. 1.

With reference to FIG. 2, there is shown an enlarged segment of the cross-sectional portion shown in FIG. 1. It should be understood that the drawings are not to scale. In a typical configuration, columns 2 would be around 75 microns high and 25 microns in diameter at the top surface of layer 3. Layer 3 would typically be around 50 microns thick and columns 2 would extend 20 to 25 microns above the layer and 3 to 5 microns below the layer.

Although columns 2 are shown in FIGS. 1 and 2 with a slight outward taper running to the top surface of layer 3, the walls do not necessarily need to taper. In this regard, the shape of the walls is not critical and vertical side walls would work as well and could be made using laser processing.

Figure 3:
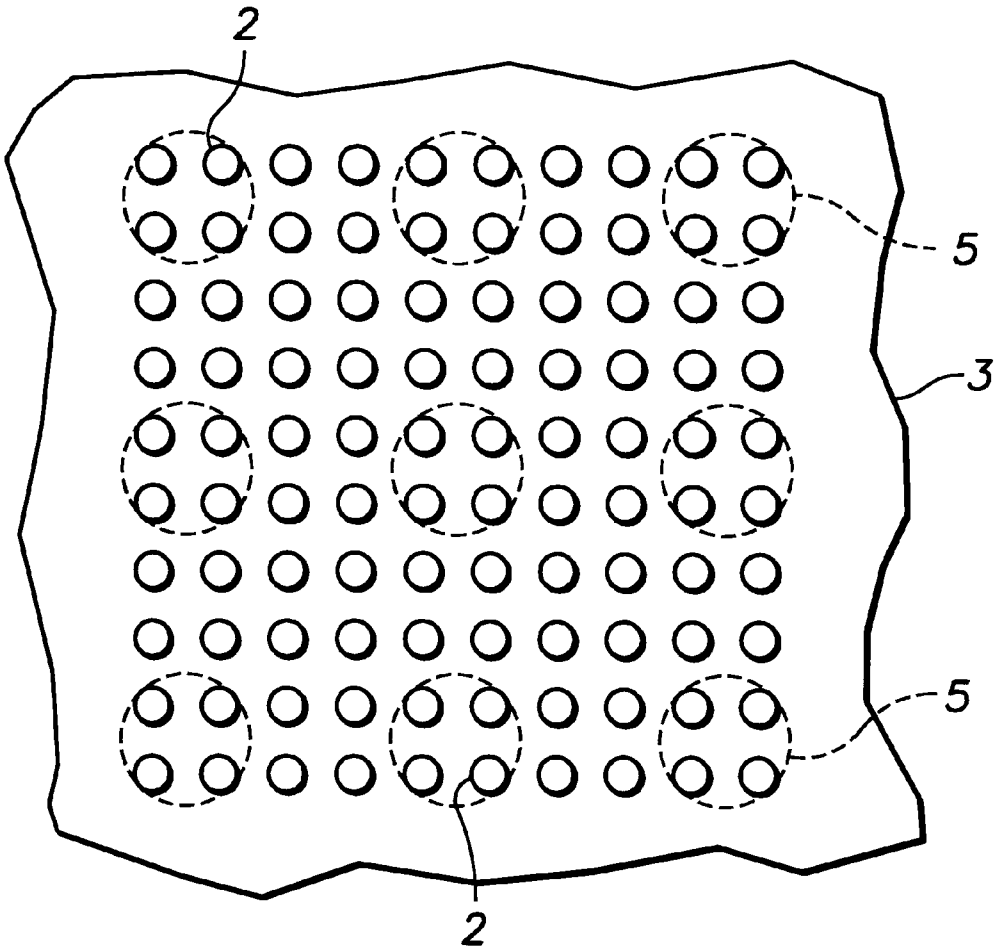
FIG. 3 shows a detailed top sectional view of the connector or interposer in accordance with the present invention.

The top sectional view of FIG. 3 shows the manner in which the high density Z axis connector positions over a typical array of solder balls 5, shown in broken lines. Typically, the balls would be 5 mils in diameter. With columns 2 spaced around 50 microns on center in both the X and Y direction and solder balls 5 spaced 8 mils on center in both the X and Y direction, it can be seen that as many as four columns make contact with each of the solder balls in the array.

Figure 4:
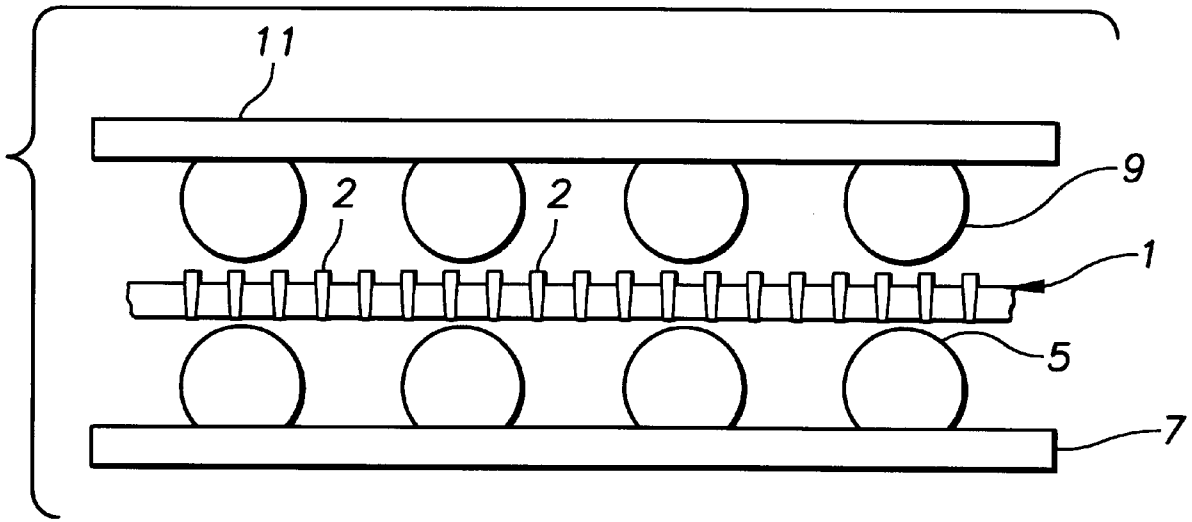
FIG. 4 shows use of the connector or interposer for connecting a wafer to a substrate where solder balls are the contact points.

FIG. 4 depicts one way the electrical connector or interposer of the present invention may be used as a connection device or probe system. Used as a probe system, the connector is interposed between a wafer and test substrate. The array of solder balls 5 on wafer 7 make contact with the nickel columns 2. Typically, four to six columns make contact with each solder ball but the density of the column array described above insures that at least two columns make contact with each solder ball and it has been found that, in practice, up to twelve nickel columns will contact each solder ball. It has also been found that the average number of contacts over a series of tests was five nickel columns making contact per solder ball. Similarly, test substrate 11, with its array of solder balls 9, makes contact with nickel columns 2, with the number of column nickel contacts per solder ball being in the same range as discussed with respect to the solder ball contacts of solder balls 5 on wafer 7.

One of the key advantages of the size and density of spacing of the array of columns, as positioned in the layer of insulation, resides in the fact that the electrical contacts of the devices to be connected, whether they be solder balls or metal pads, do not have to be aligned. In this regard, the connector may be generally positioned over the solder balls or metal pads and there will always be a sufficient number of nickel columns aligned between the contacts to be connected to make good conductive contact.

It has been found that in contact testing with solder balls, that with an average loading per solder ball of around 20 grams, each nickel column makes an indentation into the solder ball of several microns (e.g. 6 to 8) similar to the indentations on a golf ball. However, with an average loading per solder ball of 50 grams, the exposed 25 microns of each nickel column completely penetrates the solder balls thus forming a temporary plug arrangement. This could have various applications, such as, a temporary chip attach method or pinless connector arrangement.

Contact testing with sufficient loading so as to penetrate the solder balls to the extent of the exposed nickel column protrusion, as described above, plus the normal collapse of the solder balls under load gives the required Z axis compliance necessary for the probe system to effectively test in full wafer contact applications. Of course, normal reflow steps are undertaken after testing to reform the solder balls.

Figure 5:
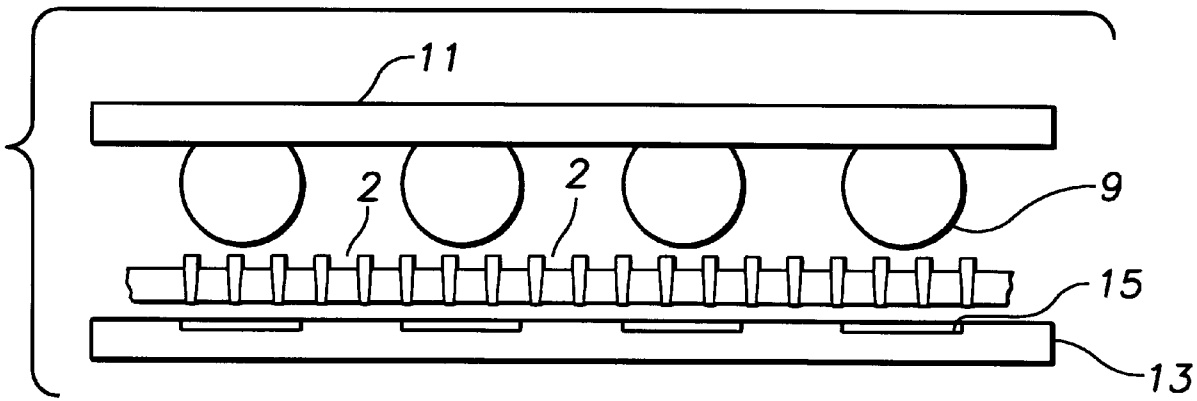
FIG. 5 shows use of the connector or interposer for connecting a wafer to a substrate where the contact points on the wafer are pads and the contact points on the substrate are solder balls.

With reference to FIG. 5, there is shown a further application of the connector as a probe system for testing. In FIG. 5, wafer 13 exhibits an array of pads 15 for contact points, instead of solder balls. The pads 15 may be made, for example, of gold. Under normal loading, as described above, solder balls 9 provide sufficient force to columns 2 to permit the columns to maintain good electrical contact to the underlying pads 15. As another alternative, solder balls 9 in FIG. 4 could be replaced with contact pads similar to that shown in FIG. 5 at points 15. In this latter arrangement, solder balls 5 on wafer 7 would, under load, provide sufficient force to columns 2 to cause them to make good electrical contact to the pads, similarly as described with respect to FIG. 5. The advantage of this latter scheme is that it would allow multiple uses of substrate 11 for testing without the need to reflow solder balls to their initials spherical shape after each test.

Figure 6A:
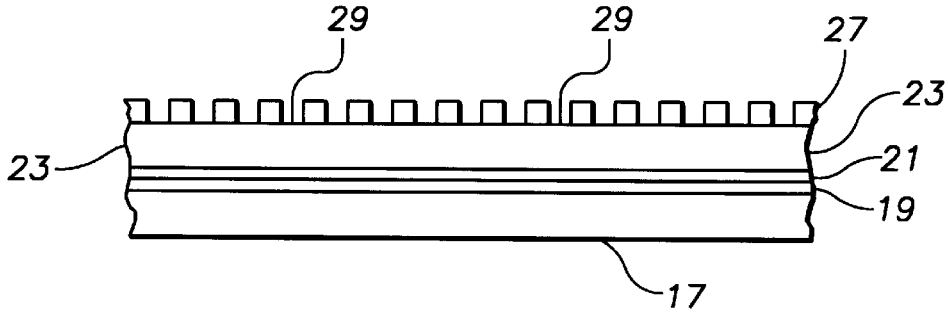
FIG. 6 depicts a series of process steps that may be used to fabricate the connector or interposer in accordance with the present invention.
Figure 7:
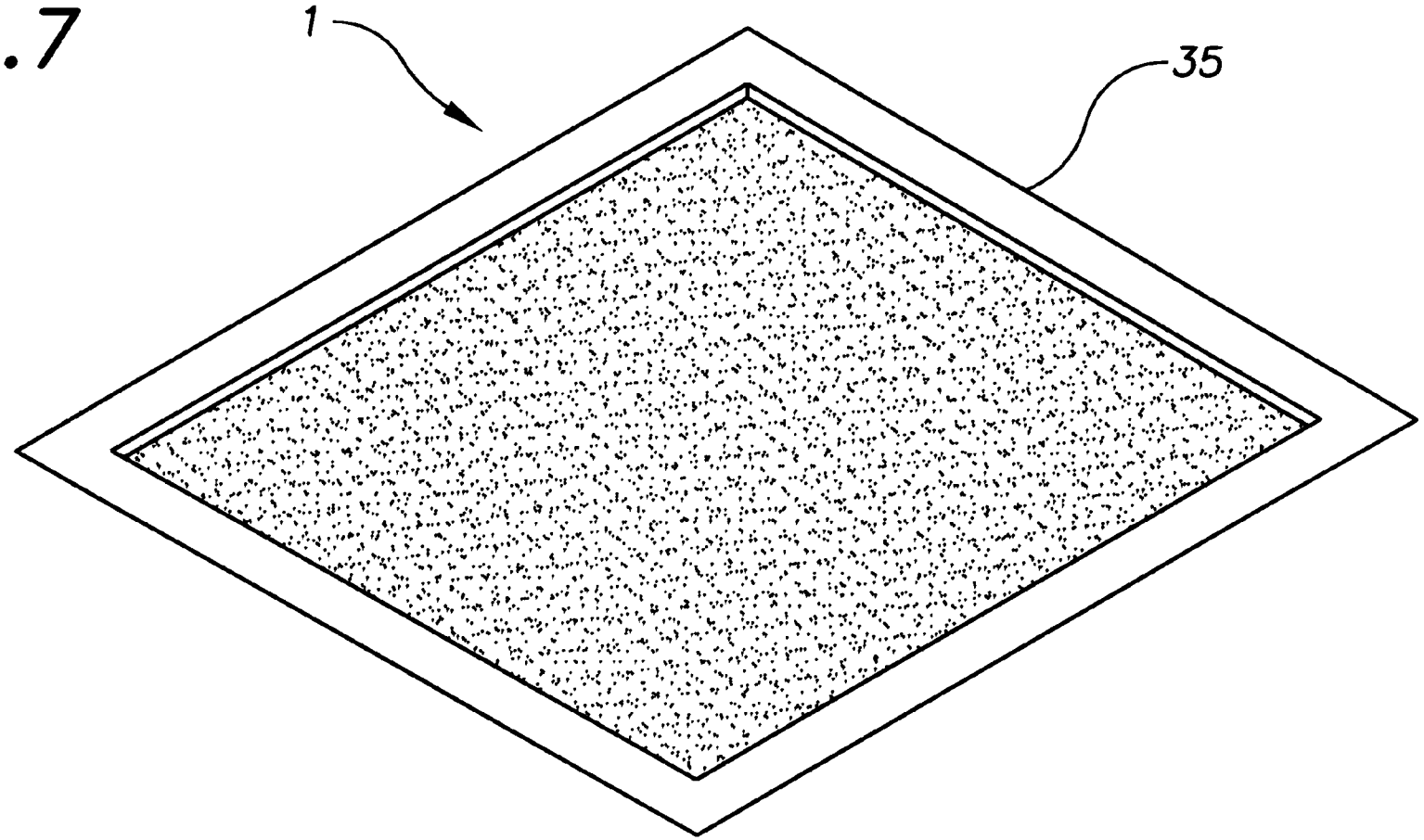
FIG. 7 shows a perspective view of the electrical connector or interposer in accordance with the present invention.

The feature dimensions of the high density Z axis connector of the present invention can best be achieved using conventional lithographic processing steps. To achieve 25 micron diameter holes on 50 micron centers in both the X and Y direction in a 50 micron thick free standing layer of insulating material, lithographic processing necessarily begins with the layer attached to a flat, rigid substrate to ensure good feature resolution. With reference to FIG. 7, the first step in the process is to prepare the carrier substrate. Substrate 17 in FIG. 6*a* is first plasma cleaned and coated with a thin layer of polyimide 19, one to four microns thick. This layer is used as a sacrificial release layer to facilitate removal of the finished layer of insulating material from the substrate after fabrication.

Once the release layer 19 is deposited and properly cured, a Chrome/Copper/Chrome seed layer 21 is sputter deposited on top of release layer 19. Although a Chrome/Copper/Chrome seed layer is used here, it is clear that other metallurgies could also be used in place of the Chrome/Copper/Chrome metallurgy. This seed layer is necessary for electroplating the nickel columns. If an electroless process is used, there is no need for the seed layer but a layer of Chrome is necessary to act as an etch stop for the laser assisted release process.

A layer of polyimide 23 is then deposited onto the seed layer. This later layer of polyimide acts as the layer of insulating material which supports the array of nickel columns 2 in the high density connector. The polyimide can be deposited by spin coating, extrusion coating or dry film lamination to produce a uniform film thickness of about 50 microns, as is well known to those skilled in the art.

Figure 6B:
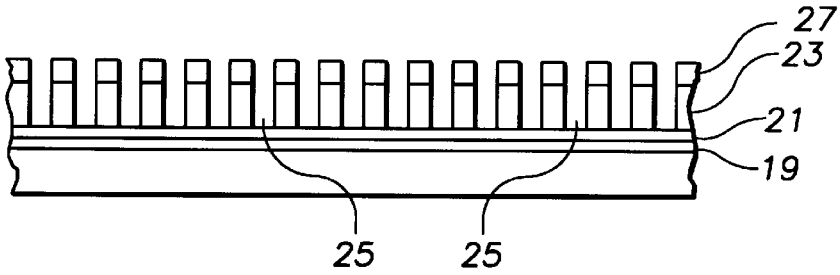

As shown in FIG. 6*b,* holes 25 are next formed in layer of polyimide 23 to facilitate creation of the column array which will subsequently be filled with nickel. The holes, which will be about 25 microns in diameter, may be formed by any one of several different techniques. For example, as shown in FIG. 6*a,* a layer of resist 27 may be deposited on the polyimide and then patterned with an array of holes 29 which are 25 microns in diameter and 50 microns on center in both the X and Y direction and correspond to the desired array of holes to be formed in the underlying layer of polyimide 23. Then, the layer of polyimide 23 is etched away in the unmasked regions to form the array of holes 25, as shown in FIG. 6*b.* For example, the layer of resist 27 may be a reactive ion etching (RIE) barrier, patterned as described above, and then an RIE process employed to remove the polyimide exposed by the holes in the RIE barrier. Alternatively, a metal layer may be deposited as the layer of resist 27 on the layer of polyimide 23 and then patterned with an array of holes through etching. After etching the array of holes in the layer of metal, a laser may be scanned over the metal surface to ablate the polyimide in the openings in the metal layer. Direct write may also be used to ablate the polyimide using a focused laser or electron beam at an array of locations corresponding to the desired location of the holes.

Figure 6C:
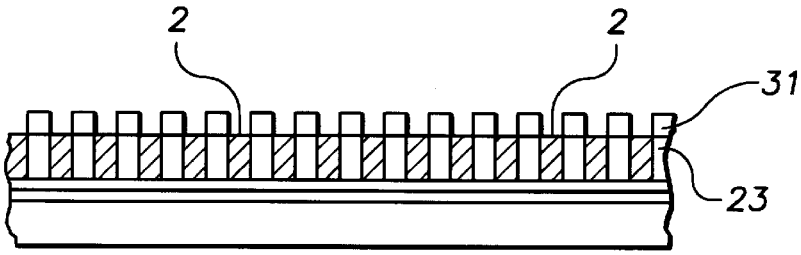

Once the array of holes 25 is formed in the layer of polyimide 23 and layer of resist 27 used to form these holes is removed, the Chrome on the Chrome/Copper/Chrome layer 21 is etched out at the bottom of the holes to expose the Copper. Nickel is then electroplated onto the exposed Copper to fill the holes to the top surface of the layer of polyimide 23 to form column 2, as shown in FIG. 6*c*. An electroless process may also be used for this purpose. Once nickel is plated to the top surface of the layer of polyimide 23, a new layer of photoresist 31 is deposited to a thickness of approximately 25 microns and is then patterned to form an array of holes aligned to the nickel filled holes, as shown in FIG. 6*c*. Electroplating into the patterned photoresist is then carried out to create an additional 25 micron extension to the nickel columns 2 which will form the 25 micron protrusion beyond the layer of polyimide 23 once the layer of photoresist 31 is removed. This is shown in FIG. 6*d*.

Figure 6D:
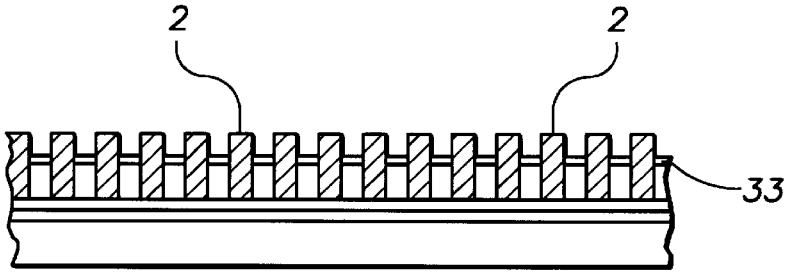

After the layer of photoresist 31 is removed, a thin layer of polyimide 33 is deposited on layer of polyimide 23, as shown in FIG. 6*d*, to thereby add mechanical integrity to the protruding nickel columns. This may be deposited by spin coating polyimide to a thickness of 2 to 3 microns. After depositing this latter layer of polyimide, a plasma clean process is used to remove any unwanted polyimide on the protruding portion of the nickel columns.

As shown in FIG. 7, a rigid frame 35 may then be attached to the perimeter of the layer of polyimide 23 to impart stability and ease of handling once it is released from substrate 17. Metal, such as stainless steel, may be used to fabricate the frame. The frame may be attached by epoxy, lamination or any other technique which provides good adhesion of the polyimide to the frame and does not damage the protruding array of nickel columns extending beyond the surface of the polyimide.

The process of releasing the layer of polyimide from substrate 17 shown in FIG. 6 varies depending upon the substrate used. Where the substrate is glass, the polyimide may be released by using a scanning laser across the backside of the glass to ablate the polyimide release layer 19 resulting in release of polyimide layer 23 with its array of nickel columns 2. Where the substrate is silicon, release may be achieved by immersion in buffered HF which acts to etch the silicon surface resulting in the delamination of the layer of polyimide 23 with its array of nickel columns.

Figure 6E:
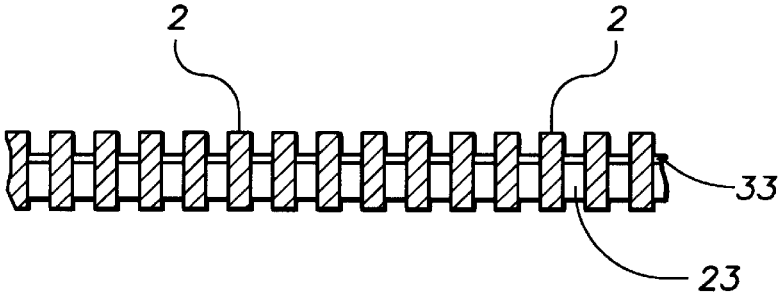

Once the layer of polyimide 23 with nickel columns is attached to the frame and released from substrate 17, the backside of the layer of polyimide is next treated to expose the nickel columns. Thus, after release from the substrate, any remaining polyimide from the release layer or other process debris is removed by plasma etch or RIE. Next, the Chrome/Copper/Chrome layer is etched away to expose the nickel columns 2. Then, a plasma etch or RIE is used to etch back about 3 microns of the layer of polyimide 23 to allow the nickel columns to extend about 3 microns below the surface of the layer of polyimide, as shown in FIG. 6*e*.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A method of making electrical connection between electronic devices each having a set of electrical contacts to be respectively connected to the other with the set of electrical contacts of at least one of said electronic devices being solder ball contacts, comprising:

positioning in both the X and Y directions a uniform array of rigid conductive metal columns orthogonal to a plane between said devices with each of said conductive metal columns of said array of conductive metal columns being parallel to one another and no more than 25 microns in diameter and 50 microns apart and electrically insulated from one another and held in a layer of material so as to extend beyond each of the opposing surfaces thereof with the spacing between said conductive metal columns sufficient to cause more than one conductive metal column of said array of conductive metal columns to align with each of the electrical contacts of said set of electrical contacts of each of said electronic devices to be respectively connected to the other; and applying sufficient loading force to said electronic devices so as to cause said rigid conductive metal columns to make conductive contact with each of the electrical contacts of said electronic devices to be connected with said loading force sufficient to cause more than one of said conductive metal columns to form indentations into each of said solder ball contacts of said at least one of said electronic devices.

2. The method as set forth in claim 1, wherein the step of applying loading force to said electronic devices comprises applying an average loading force of about 20 grams per solder ball so as to cause said rigid conductive metal columns to form an indentation of several microns into said solder balls of said at least one of said electronic devices.

3. The method as set forth in claim 2, wherein the step of positioning an array of rigid conductive metal columns between electronic devices at least one of which said electronic devices has solder balls as said set of electrical contacts comprises positioning between one device having solder balls as said set of electrical contacts and the other having metal pads as said set of electrical contacts.

4. The method as set forth in claim 3, wherein said step of positioning an array of rigid conductive metal columns between electronic devices with one having solder balls as said set of electrical contacts and the other having metal pads as said set of electrical contacts comprises positioning between a semiconductor wafer as one device and a test substrate as the other.

5. The method as set forth in claim 2 wherein the step of applying a loading force to said electronic devices comprises applying an average loading force of about 50 grams per solder ball so as to cause said rigid conductive metal columns to penetrate said solder balls of said at least one of said electronic devices so as to form an attachment thereto.

6. A high density Z-Axis connector for interconnecting respective arrays of opposing electrical contacts on a pair of electronic devices with at least one of said respective arrays of electrical contacts being solder ball contacts on a wafer, comprising:

a thin layer of insulating material having an area at least as large as said wafer; and a two-dimensional array of equally spaced rigid metal columns formed in said layer of insulating material parallel to one another and orthogonal to the surfaces of said layer of insulating material with each of said metal columns being no more than 25 microns in diameter and 50 microns apart and uniformly extending beyond each of the opposing surfaces of said layer of insulating material so that a plurality of metal columns form indentations into each of said solder balls under load.

7. The high density Z-Axis connector of claim 6 wherein said metal columns are nickel.

* * * * *